United States Patent [19]

Ikemoto

[11] 4,094,347

[45] June 13, 1978

[54] BALLOON NECK FITTING

[76] Inventor: Kikuji Ikemoto, 100-27, Shin-narita, Hirono-cho, Uji-shi, Kyoto, Japan

[21] Appl. No.: 753,944

[22] Filed: Dec. 23, 1976

[30] Foreign Application Priority Data

Jul. 10, 1976 Japan ..... 51-135307

[51] Int. Cl.[2] ..... B65B 3/04

[52] U.S. Cl. ..... 141/313; 46/90

[58] Field of Search ..... 46/90; 137/223, 231, 137/797; 141/1, 98, 114, 167, 173, 181, 313–317, 328, 348–350, 369–372, 392

[56] References Cited

U.S. PATENT DOCUMENTS

| | | | |
|---|---|---|---|
| 2,924,041 | 2/1960 | Jackson et al. | 46/90 |
| 3,616,569 | 11/1971 | Litt et al. | 46/90 |

*Primary Examiner*—Richard E. Aegerter

*Assistant Examiner*—Frederick R. Schmidt

*Attorney, Agent, or Firm*—Browdy and Neimark

[57] ABSTRACT

A balloon neck fitting to be attached to the neck of a balloon sold by a balloon vending machine. The balloon neck fitting consists of a check valve section and a guide section, and these two sections, though initially joined together, will be separated from each other when the associated balloon is inflated and delivered from the vending machine. The check valve section is fitted in the neck of a balloon and serves to prevent backward flow of the gas from inside the inflated balloon, while the guide section serves as a guide when the neck fitting is moved within the vending machine. The check valve and guide sections separated from each other have been tied together by a string and the guide section serves as a hook for the finger when the purchaser carries with him the balloon.

6 Claims, 7 Drawing Figures

BALLOON NECK FITTING

FIELD OF THE INVENTION

The present invention relates to a balloon neck fitting to be attached to the neck of a balloon sold by a balloon vending machine, and more particularly it relates to a balloon neck fitting consisting of a check valve section adapted to be fitted in the neck of a balloon and a guide section used when the neck fitting is moved within the vending machine, said check valve and guide sections being initially joined together but adapted to be separated from each other when the balloon is sold and delivered from the vending machine.

BACKGROUND OF THE INVENTION

A balloon neck fitting for use in a balloon vending machine has already been proposed in U.S. Pat. No. 3,380,490. The balloon neck fitting proposed therein, however, is attached to the neck of a balloon and has only the check valve function of preventing backward flow of the gas from inside the balloon. Such balloon neck fittings are equidistantly attached to a long belt and their movement within the vending machine is effected by moving the belt. According to this system, therefore, it is necessary to use a belt without fail and, moreover, the operation of attaching balloon neck fittings to this belt is involved.

SUMMARY OF THE INVENTION

An object of the present invention is to provide a balloon neck fitting adapted to be fitted in the neck of a balloon and perform the check valve function of preventing reverse flow of the gas from inside the balloon and the guide function of guiding the balloon within the balloon vending machine.

Another object of the invention is to provide a balloon neck fitting consisting of a check valve section and a guide section, which, initially joined together, are separated from each other when the associated balloon is sold and delivered.

A further object of the invention is to provide a balloon neck fitting wherein the check valve and guide sections, when separated from each other, have already been tied together by a single string and the guide section serves as a hook for the finger when the purchaser carries with him the balloon.

Still another object of the invention is to provide a balloon neck fitting wherein the boundary between the check valve and guide sections can be broken with a very small amount of force.

DESCRIPTION OF THE PREFERRED EMBODIMENTS

Balloon neck fittings according to embodiments of the present invention will now be described with reference to the drawings.

Figure 1:
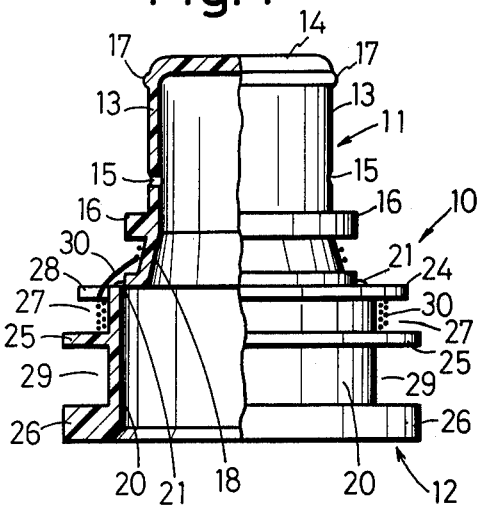
FIG. 1 is a side view of an embodiment of the present invention, substantially the left half being shown in section.

As shown in FIG. 1, a balloon neck fitting 10 consists of a check valve section 11 and a guide section 12. The balloon neck fitting 10 is made of a plastic material in such a manner that the check valve and guide sections 11 and 12 are joined together. The check valve section 11 is substantially cylindrical. The lateral wall 13 of the check valve section 11 presenting a cylindrical shape has its upper end closed by an upper end wall 14 and its lower end opened. Several gas passage holes 15 are formed in the lateral wall 13 at suitable positions adjacent the middle region thereof. At a position slightly below the level of the row of gas passage holes 15 and annularly projecting from the outer surface of the lateral wall 13 is a flange 16 adapted to anchor the neck of a balloon A. Further, a small flange 17 is formed adjacent the upper end of the lateral wall 13. When the balloon neck fitting 10 is fitted in the neck B of the balloon A, it contacts the inner wall of the neck B of the balloon so intimately that there is no possibility of the balloon A readily coming off the balloon neck fitting 10 or of the gas which has been blown into the balloon A flowing backward. The lower end portion of the lateral wall 13 is tapered, as shown at 18. The inner diameter and gradient of the tapered portion 18 coincide with those of the tapered portion of the lateral wall of a gas supplying nozzle C. The check valve section 11 of the balloon neck fitting 10 constructed in the manner described above is fitted in the neck B of the balloon A. In this connection, it is to be noted that it is fitted deep so that the end of the neck B of the balloon A lies beyond the flange 16 of the check valve section 11.

Figure 2:
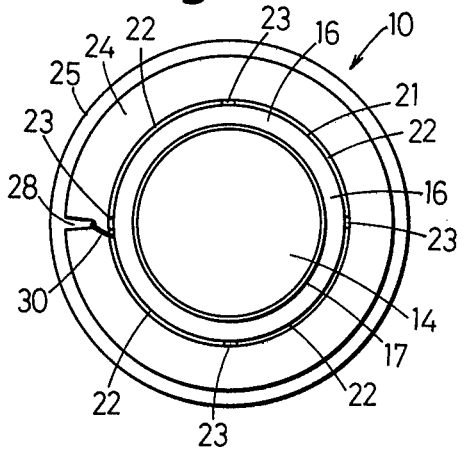
FIG. 2 is a top view of the embodiment shown in FIG. 1.

The guide section 12 has a substantially cylindrical lateral wall 20. The diameter of the lateral wall 20 of the guide section is larger than that of the lateral wall 13 of the check valve section 11, and the upper end of the lateral wall 20 and the lower end of the lateral wall 13 are joined together by a connecting portion 21. The connecting portion 21 is formed with cuts 22 to provide for easy breakage or separation. In order to provide such construction, the embodiment employs a method in which the upper end of the lateral wall 20 and the lower end of the lateral wall 13 are joined together by several joint strips 23, as shown in FIG. 2. The lateral wall 20 is formed with three flanges disposed at the upper end, the intermediate region and the lower end, respectively. The upper end flange 24 is smaller than the other flanges and serves to hold the string wound on the lateral wall 20 so as to prevent unwinding thereof. The intermediate and lower end flanges 25 and 26 are adapted to engage rails D. The string 30 which supports the inflated balloon A is wound in a groove 27 between the flanges 24 and 25. The string 30 is tied at its upper end to the check valve section 11 and at its lower end to the guide section 12. The flange 24 is formed with a notch 28 so that after the end of the string 30 wound in the groove 27 is received in said notch it is tied to the check valve section 11, whereby the string 30 wound in the groove 27 is prevented from being accidentally unwound. A groove 29 defined between the flanges 25 and 26 is adapted to receive the rails D. Since the rails D are parallelly arranged in opposed relation to each other, the guide section can be moved along the rails D while being engaged with the latter.

The way in which the balloon neck fitting of the present invention is used will now be described.

Figure 3:
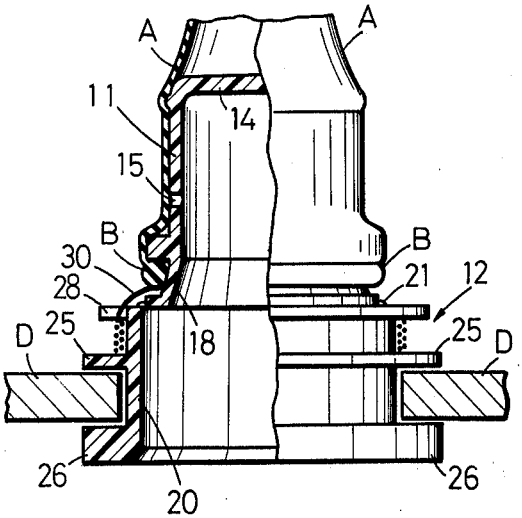
FIG. 3 is a side view of the embodiment shown in FIG. 1, in the state of being fitted in the neck of a balloon, substantially the left half being shown in section.
Figure 4:
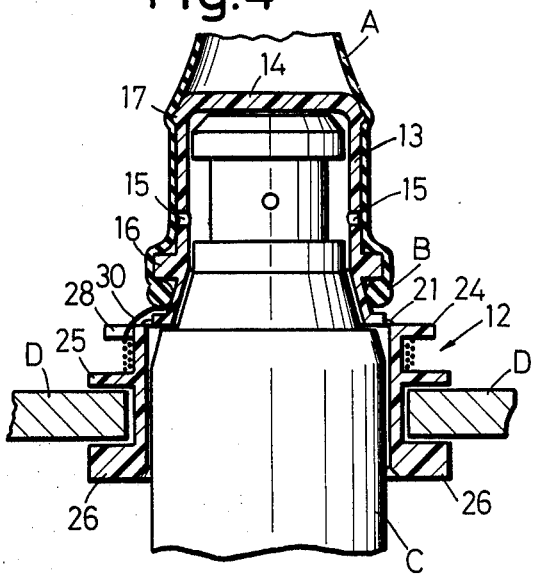
FIG. 4 is a sectional view of the embodiment shown in FIG. 3, engaged with rails and having a gas supply nozzle fitted therein.
Figure 5:
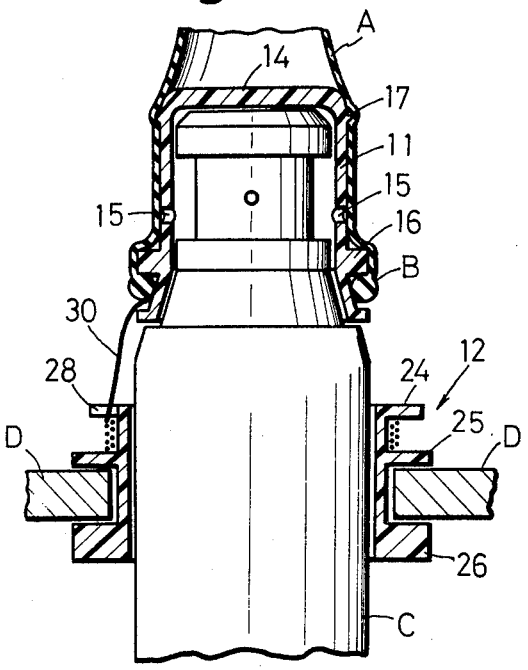
FIG. 5 is a sectional view of the embodiment shown in FIG. 4, separated into two parts.
Figure 6:
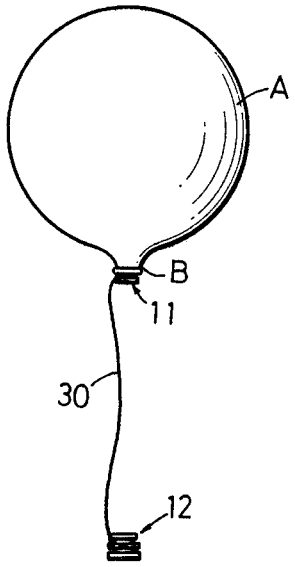
FIG. 6 is a side view of a balloon using the embodiment shown in FIG. 1, delivered from a balloon vending machine.

First of all, the balloon neck fitting 10 is fitted in the neck B of the balloon A. In this connection, it is fitted deep to the extent that the neck B of the balloon lies beyond the flange 16 of the lateral wall 13 of the check valve section 11. Once the check valve section 11 is fitted in the neck B of the balloon A in this manner, the elastic material, such as rubber, from which the balloon is made allows the inner wall of the neck B of the balloon A to intimately contact the outer wall of the check valve section 11, thereby closing the gas passage holes 15. The balloon A having the balloon neck fitting thus attached to the neck B thereof is then accommodated in the balloon vending machine in non-inflated condition. In this case, it is accommodated therein with the balloon neck fitting 10 engaged with the rails D. Of course, a number of such balloons each having such balloon neck fitting attached thereto are accommodated in the balloon vending machine. The balloons thus accommodated will be conveyed one by one to the balloon inflating position along the rails D. At the balloon inflating position, the gas supplying nozzle C is inserted into the balloon neck fitting 10, as shown in FIG. 3, and a gas, such as helium, is blown into the balloon through the gas supplying nozzle C. In this connection, the tapered portion 18 in the lower end portion of the lateral wall 13 of the balloon neck fitting 10 serves as a guide to facilitate the insertion of the nozzle C into the balloon neck fitting 10, and when the nozzle C is thus inserted, the tapered portion 18 is intimately contacted with the corresponding tapered portion of the nozzle C, leaving no clearance therebetween so that there is no possibility of leakage of the gas. When the gas is blown out of the nozzle C, the high pressure of the gas forces the gas to pass through the gas passage holes 15, stretching or pushing aside the wall of the balloon A to create a clearance between the balloon and the fitting through which the gas enters the balloon A. As a result, the balloon A is inflated. When the blowing of the gas is stopped, the wall of the neck B of the balloon A is contracted to intimately contact the lateral wall 13 of the check valve section 11 again, thereby closing the gas passage holes 15. In this way, as soon as the supply of the gas is stopped, the gas passage holes 15 are closed, so that there is no possibility that the gas blown into the balloon will flow backward. Upon completion of the operation of inflating the balloon, the balloon neck fitting 10 is separated along the connecting portion 21, as shown in FIG. 5. The separation of the balloon neck fitting 10 is effected either by pulling the rails D downward with the nozzle C maintained fixed in position or by pushing the nozzle C upward with the rails D maintained fixed in position. In this connection, since the connecting portion 21 is provided with cuts 22, a very small amount of force is enough for separation. When the balloon neck fitting is thus separated, the check valve section 11, fitted in the neck B of the balloon A, hovers with the balloon A, while the guide section remains on the rails D. Since the separated check valve and guide sections 11 and 12 have been tied together by the string 30, the balloon A does not hover higher than the length of the string 30. The guide section 12 will then be detached from the rails D by the purchaser. Since the guide section 12 presents an annular form, this is convenient in that the purchaser is allowed to hook his finger in the guide section 12 as he carries with him the balloon.

Figure 7:
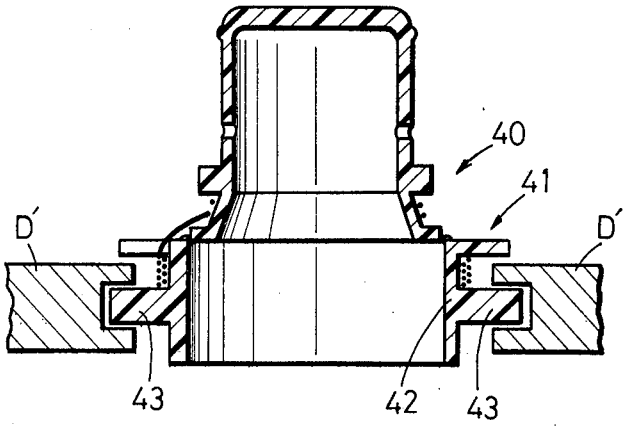
FIG. 7 is a sectional view of another embodiment of the invention, showing only the guide section thereof.

Another embodiment of the invention is shown in FIG. 7. In this embodiment, the relation between the guide section 41 of a balloon neck fitting 40 and rails D′ is different from that shown in FIG. 1 in that a flange 43 formed on the lateral wall 42 of the guide section 41 is fitted in grooves in the rails D′ so as to establish engagement therebetween.

What is claimed is:

1. A balloon neck fitting, for use in a balloon vending machine having a transporting mechanism to transport the balloons therethrough and a gas supply nozzle to fill the balloon with gas, comprising:

a. a cylindrical check valve section having a configuration adapted to be fitted in the neck of a balloon, and being closed at the one end to be inserted into the neck of the balloon and open at the other end, and having several openings in the lateral wall thereof;

b. guide means for engaging the transporting mechanism of the balloon vending machine, said guide means comprising an open-ended cylindrical guide section;

c. frangible connecting means for connecting said guide section with the open end of said check valve section in such a manner as to readily permit breaking of the connection;

d. a string connected at one end to said check valve section, and connected at the other end to said guide section; and e. said open ended cylindrical guide section and said check valve section open end being sized to receive therein the gas supply nozzle of the balloon vending machine, whereby, after the balloon is filled with gas by means of the gas supply nozzle, said frangible connecting means is caused to be broken, leaving said sections connected only by said string.

2. A balloon neck fitting in accordance with claim 1, wherein the open end of said cylindrical check valve section is tapered outwardly so as to receive a correspondingly tapered portion of the gas supply nozzle of the balloon vending machine.

3. A balloon neck fitting in accordance with claim 1, wherein said check valve section further includes flange means for anchoring the neck of the balloon when the check valve section is fitted thereinto, said flange means comprising a flange projecting from the outer surface of the lateral wall of said check valve section.

4. A balloon neck fitting in accordance with claim 1, wherein the lateral wall of the cylindrical guide section is formed with at least one outwardly extending flange thereon for engagement with the transporting mechanism of the balloon vending machine.

5. A balloon neck fitting in accordance with claim 1, wherein said frangible connecting means is provided with cuts thereon to increase the frangibility thereof.

6. A balloon neck fitting in accordance with claim 1, wherein said string is wound around the lateral wall of said cylindrical guide section, except for the end of said string connected to said check valve section.

* * * * *